US008931124B2

(12) United States Patent
Daley

(10) Patent No.: US 8,931,124 B2
(45) Date of Patent: Jan. 13, 2015

(54) SURGICAL TABLE HAVING OVERLOAD DETECTION MEANS

(75) Inventor: Michael William Daley, Mentone (AU)

(73) Assignee: Medsell Pty. Ltd., Moorabbin (AU)

( * ) Notice: Subject to any disclaimer, the term of this patent is extended or adjusted under 35 U.S.C. 154(b) by 784 days.

(21) Appl. No.: 13/139,874

(22) PCT Filed: Dec. 16, 2009

(86) PCT No.: PCT/AU2009/001626

§ 371 (c)(1),
(2), (4) Date: Mar. 1, 2012

(87) PCT Pub. No.: WO2010/068977

PCT Pub. Date: Jun. 24, 2010

(65) Prior Publication Data

US 2012/0198621 A1 Aug. 9, 2012

(30) Foreign Application Priority Data

Dec. 16, 2008 (AU) ..... 2008906461
Apr. 29, 2009 (AU) ..... 2009901845

(51) Int. Cl.

| | |
|---|---|
| ***A47B 71/00*** | (2006.01) |
| ***A61G 13/08*** | (2006.01) |
| ***A61G 13/04*** | (2006.01) |
| *H01H 35/38* | (2006.01) |

(52) U.S. Cl.

CPC ..... *A61G 13/08* (2013.01); *A61G 13/04* (2013.01); *A61G 2203/32* (2013.01); *A61G 2203/34* (2013.01); *H01H 35/38* (2013.01)

USPC ..... 5/600; 5/614; 5/616

(58) Field of Classification Search

USPC ..... 5/600, 614, 616; 73/798, 816, 825; 177/144

See application file for complete search history.

(56) References Cited

U.S. PATENT DOCUMENTS 4,529,975 A * 7/1985 Hung ..... 340/626
4,604,559 A * 8/1986 Hawkes et al. ..... 318/563
4,959,957 A * 10/1990 Schmale et al. ..... 60/413

(Continued)

FOREIGN PATENT DOCUMENTS

GB 2260075 A 4/1993
GB 2452065 A 2/2009
GB 24520655 A 2/2009

OTHER PUBLICATIONS

Conway, H.G., "Fluid Pressure Mechanisms"; Sir Isaac Pitman & Sons, Ltd.; London, 1949.

*Primary Examiner* — Nicholas Polito
*Assistant Examiner* — Richard G Davis
(74) *Attorney, Agent, or Firm* — Gerald E. Helget; Briggs and Morgan, P.A.

(57) ABSTRACT

A surgical table for supporting a patient, the surgical table including:

a base assembly (3); a table top (1) for supporting a patient thereon, the table top (1) being moveable with respect to the base assembly (3); at least one actuator (13) for controlling the position of the table top (1) with respect to the base assembly (3); and an overload detection means for detecting when the surgical table is overloaded, the overload detection means including a sensor (25) for sensing a parameter of the surgical table such as hydraulic fluid pressure in the actuator (13), wherein the overload detection means emits a signal if the parameter sensed exceeds a predetermined value, due to the weight and/or position of the patient on the table top (1).

14 Claims, 3 Drawing Sheets

(56) References Cited

U.S. PATENT DOCUMENTS

| | | | | |
|---|---|---|---|---|
| 5,220,698 | A * | 6/1993 | Hannant | 5/611 |
| 6,785,597 | B1 * | 8/2004 | Farber et al. | 701/50 |
| 7,276,669 | B2 * | 10/2007 | Dahl et al. | 177/45 |
| 7,971,295 | B2 * | 7/2011 | Dippl et al. | 5/611 |
| 8,272,521 | B1 * | 9/2012 | Kemmerly et al. | 212/278 |
| 2006/0193443 | A1 | 8/2006 | Reger | |
| 2007/0200396 | A1 | 8/2007 | Baumann et al. | |
| 2009/0031497 | A1 | 2/2009 | Meissner et al. | |
| 2010/0132117 | A1 * | 6/2010 | Westermann | 5/600 |

* cited by examiner

SURGICAL TABLE HAVING OVERLOAD DETECTION MEANS

CROSS REFERENCE TO RELATED APPLICATIONS

The present application is based on and claims priority to International Application PCT/AU2009/001626 filed on Dec. 16, 2009, Australian Patent Application No. 2009901845 filed on Apr. 29, 2009 Australian Patent Application No. 2008906461 filed on Dec. 16, 2008.

FIELD OF THE INVENTION

The present invention relates to a surgical table having a moveable table top for supporting a patient during a medical procedure.

BACKGROUND OF THE INVENTION

Surgical tables include a table top for supporting a patient during a medical procedure, and an underlying base assembly. The base assembly typically includes some form of supporting column upon which the table top is mounted. The table top is typically made up of a plurality of interconnected table top sections, for example a head supporting section, a back supporting section and a leg supporting section. The table top can usually be tilted at varying angles with respect to the supporting column. Similarly, the table top sections can normally be orientated at varying angles with respect to each other such that the patient can be suitably positioned for the required medical procedure.

In some instances the table top is also able to slide longitudinally with respect to the base assembly. This is particularly advantageous as it permits greater access to all areas of the patient, for example in the event that x-ray images of different parts of the patient's body are required. In this respect, the table top with the patient thereon can be readily slid between opposing ends of a C-shaped x-ray image intensifier, with one end of the intensifier being underneath the patient and the other being above, without being obstructed by the supporting column of the surgical table.

A problem with titling and/or sliding the table top with respect to the underlying support column is that the weight of the patient can make the surgical table unstable and potentially tip over. In this respect, it is not uncommon for a patient to be positioned towards one end of the table top for a medical procedure. For example, when a patient's legs are required to be in stirrups, the patient would typically lie on their back with their pelvis located at one end of the table top. In such a position, the risk of the surgical table becoming unstable is potentially great. Similarly, the risk of the surgical table becoming unstable and toppling over is exacerbated if the patient is overweight and/or the table top is slid or tilted towards one extreme position.

In the past, attempts have been made to minimise the risk of a surgical table becoming unstable by educating medical staff as to the maximum patient weight which can safely be supported by the surgical table and also educating medical staff as to how to correctly position a patient on the table top such that the risk of the table becoming unstable is minimised.

It would be desirable to provide a surgical table which overcomes or ameliorates the above mentioned problem of the prior art.

Any discussion of documents, devices, acts or knowledge in this specification is included to explain the context of the invention. It should not be taken as an admission that any of the material formed part of the prior art base or the common general knowledge in the relevant art in Australia or any other country on or before the priority date of the claims herein.

SUMMARY OF THE INVENTION

In accordance with a first aspect of the present invention there is provided a surgical table for supporting a patient. The surgical table includes:

a base assembly;

a table top for supporting a patient thereon, the table top being moveable with respect to the base assembly;

at least one actuator for controlling the position of the table top with respect to the base assembly; and an overload detection means for detecting when the surgical table is overloaded, the overload detection means including a sensor for sensing a parameter of the surgical table, wherein the overload detection means emits a signal if the parameter sensed exceeds a predetermined value, due to the weight and/or position of the patient on the table top.

In a preferred embodiment, the actuator is hydraulic and the parameter sensed is hydraulic pressure within the hydraulic actuator. In this respect, the sensor is preferably a hydraulic pressure switch.

The hydraulic actuator includes a piston within a cylinder of the actuator. The piston divides the cylinder into an upper section and a lower section. The hydraulic pressure switch preferably includes a first chamber having a fluid port connected to an upper section of the cylinder by a first hydraulic fluid line. The hydraulic pressure switch may further include a second chamber having a fluid port connected to the lower section of the cylinder by a second hydraulic fluid line.

The first and second chambers may each include a sealing member which is able to move with respect to side walls of the chambers. A region between the first chamber's sealing member and the first chamber's fluid port defines a first fluid cavity, and a region between the second chamber's sealing member and the second chamber's fluid port defines a second fluid cavity.

An increase or decrease in hydraulic fluid pressure in the upper section of the cylinder provides a corresponding increase or decrease in hydraulic fluid pressure in the first fluid cavity. Similarly, an increase or decrease in hydraulic fluid pressure in the lower section of the cylinder provides a corresponding increase or decrease in hydraulic fluid pressure in the second fluid cavity. The corresponding increase or decrease in the hydraulic fluid pressure in the first and second fluid cavities preferably acts on the sealing members.

The pressure switch may further include a drive arm having one end connected to the first chamber's sealing member and the other end connected to the second chamber's sealing member. The drive arm includes a member or projection which is positionable to operate an electrical switch, to activate an overload indicator of the overload detection means, when the parameter sensed exceeds the predetermined value. The signal emitted if the parameter sensed exceeds the predetermined value may be an audible or visual signal from the overload indicator.

The first chamber may further include a spring positioned therein to bias the first chamber's sealing member and the drive arm to a position which prevents the drive arm from closing the electrical switch. In addition, the first chamber can include an adjustable spacer between the spring and an end wall of the first chamber for enabling adjustment of the biasing force of the spring.

In an alternative embodiment, the sensor is a force transducer and the parameter sensed is force applied on the actuator.

The surgical table of the present invention advantageously provides medical personnel, surgeons and the like with an indication as to when the surgical table is overloaded and thereby at risk of becoming unstable and tipping over.

It should be understood that throughout the specification and claims the term "surgical table" is intended to include within its scope any type of table which is intended to support a patient during a medical procedure, for example surgery, operations, magnetic resonance imaging (MRI), x-ray imaging, non-surgical procedures and the like.

BRIEF DESCRIPTION OF THE DRAWINGS

Further benefits and advantages of the present invention will become apparent from the following description of preferred embodiments of the invention. The preferred embodiments should not be considered as limiting any of the statements in the previous section. The preferred embodiments will be described with reference to the following figures in which.

DESCRIPTION OF PREFERRED EMBODIMENTS

Figure 1:
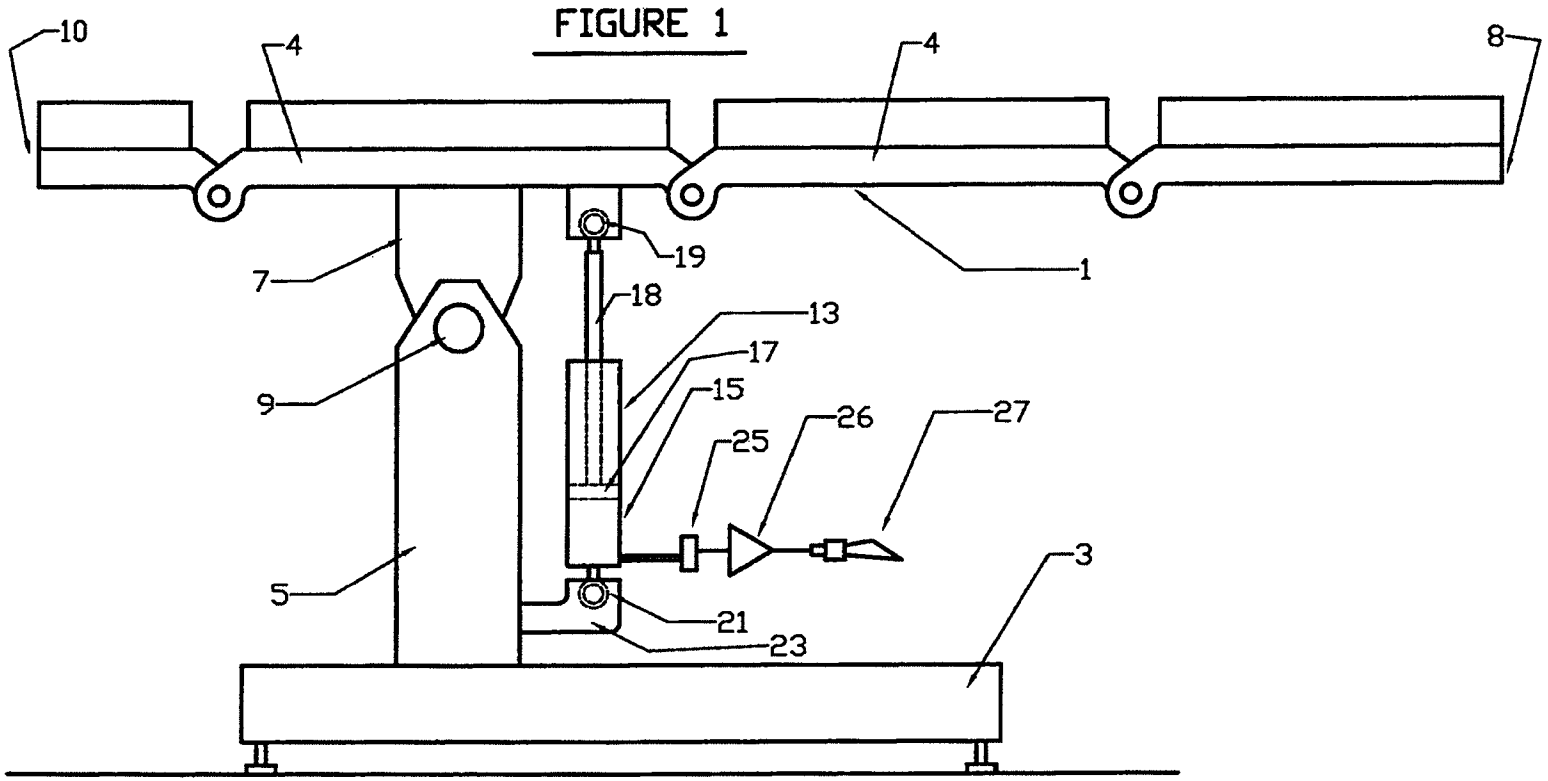
FIG. 1 illustrates a side view of a surgical table, according to one embodiment of the invention.

With reference to FIG. 1 of the accompanying drawings there is shown a surgical table in accordance with an embodiment of the invention. The surgical table includes a table top 1 which is movable with respect to a base assembly 3. The table top 1 preferably includes a plurality of table top sections 4 which are linked together. In the surgical table illustrated in FIG. 1, the base assembly 3 includes a support column 5 which has one end pivotally connected to a connecting arm 7 of the table top 1 via a connecting pin 9 which defines a horizontal transverse pivot axis. The table top 1 is thereby able to pivot with respect to the base assembly 3 about the horizontal transverse axis such that the table top 1 can assume a Trendelenburg position (head down), a reverse Trendelenburg position (head up) and any position therebetween. In other embodiments (not illustrated), the base assembly 3 may be constructed to also permit the table top 1 to move in other ways. For example, slide with respect to the base assembly 3 and also laterally tilt about a longitudinal axis of the table top 1. The table top 1 is positioned off-centre with respect to the support column 5 with a first end 8 of the table top 1 being further from the support column 5 than a second end 10.

In order to control the movement of the table top 1 about the horizontal transverse axis, the surgical table further includes at least one actuator, otherwise known as the Trendelenburg actuator, having one end preferably connected to the table top 1 and an opposing end preferably connected to the base assembly 3. The surgical table may also include other actuators (not illustrated in the drawings) to control movement of the table top 1 in other directions, for example lateral tilt about the longitudinal axis and sliding movement with respect to the base assembly 3. In the embodiments of the invention illustrated in the Figures, the Trendelenburg actuator is in the form of a hydraulic actuator 13 which is preferably double-acting. The hydraulic actuator 13 is of conventional construction and includes a cylinder 15 having hydraulic fluid therein and a piston 17 and associated piston rod 18. In FIG. 1, one end 19 of the hydraulic actuator 13 is connected to the table top 1 and an opposing end 21 is connected to a mounting arm 23 of the support column 5. The hydraulic actuator 13 is positioned underneath the table top 1 between the connecting pin 9 defining the horizontal transverse pivot axis and the first end 8 of the table top 1. Accordingly, when the table top 1 is in a horizontal position, the hydraulic actuator 13 supports the table top 1 and prevents the first and second ends 8, 10 of the table top 1 from moving downwardly and upwardly, respectively.

The surgical table further includes an overload detection means for detecting when the table top 1 is at its load limit. The overload detection means includes a sensor for sensing a parameter of the surgical table. The overload detection means functions to emit a signal if the parameter sensed exceeds a predetermined value. In the embodiment illustrated in FIG. 1, the sensor is a hydraulic pressure switch 25 which is connected to the hydraulic actuator 13. The overload detection means further includes an overload indicator 27 which emits an audible and/or visual indicator in the event that the hydraulic pressure switch 25 determines that hydraulic fluid pressure in the hydraulic actuator 13 has reached a chosen set pressure for activation of the pressure switch 25. The overload indicator 27 may be some form of siren, speech synthesizer, flashing light or a combination thereof. The overload detection means may further include a power supply, preferably in the form of a battery 26, which is electrically connected to the pressure switch 25 and the overload indicator 27. The pressure switch 25 is preferably set such that the switch 25 is activated, when a certain amount of force is applied onto the table top 1. For example, if a patient is positioned towards the first end 8 of the table top 1 the weight of the patient will cause an increase in the hydraulic fluid pressure in the lower section of the Trendelenburg actuator 13. Depending upon the size and position of the patient on the table top 1, the force exerted on the table top 1 by the patient may be sufficient to increase the hydraulic fluid pressure in the lower section of the Trendelenburg actuator 13 to a level at which the pressure switch 25 is activated with an overload indicator being subsequently emitted. The indicator providing a warning to medical staff that the weight of the patient cannot safely be supported in that position on the table top 1. The overload detection means does not however impede, restrict or limit the range of movement of the table top 1, including when an overload is detected.

The pressure switch 25, if connected to the region of the cylinder 15 where the piston rod 18 is located, may also be able to be activated when hydraulic fluid pressure in the upper section of the Trendelenburg actuator 13, where the piston rod 18 is located, increases to a certain level. For example, if a patient is positioned towards the second end 10 of the table top 1, the force exerted on the table top 1 by the patient will act to extend the piston rod 18 away from the cylinder 15 which in turn will cause an increase in hydraulic fluid pressure in the upper section of the Trendelenburg actuator 13. The increase in pressure may be sufficient for the pressure switch 25 to be activated and an overload indictor subsequently emitted to warn that a patient of such weight can not safely be supported in that position on the table top 1. Hydraulic fluid pressure is thereby effectively used as a measure of the force imparted on the table top 1 by the patient. The force imparted being dependent upon the weight and position of the patient. The pressure switch 25 may also be able to be activated when hydraulic fluid pressure in the Trendelenburg actuator 13 decreases to a certain level.

Figure 2:
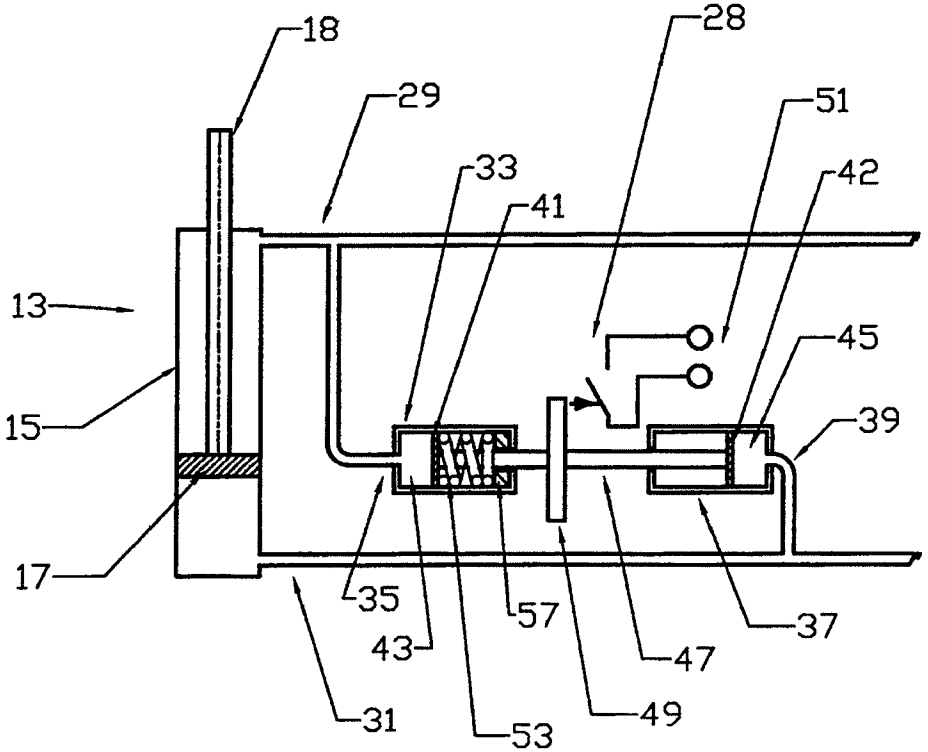
FIG. 2 illustrates a hydraulic actuator and pressure switch of the surgical table, according to another embodiment of the invention.
Figure 3:
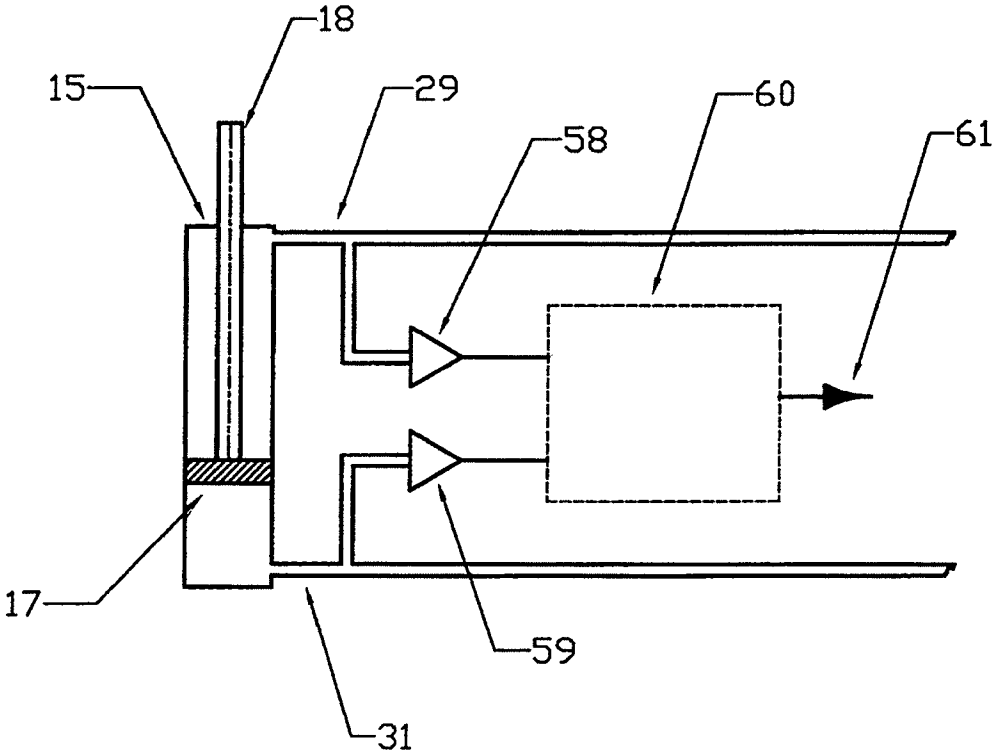
FIG. 3 illustrates a hydraulic actuator and pressure switch of the surgical table, according to yet another embodiment of the invention.

In the embodiments of the invention illustrated in FIGS. 2 and 3, the pressure switch is in the form of a differential pressure switch 28. The differential pressure switch 28 is operatively connected to the hydraulic actuator 13. The hydraulic actuator 13 shown in FIGS. 2 and 3 is preferably the Trendelenburg actuator of the surgical table. However, the hydraulic actuator 13 shown could be any other actuator of the surgical table. As the hydraulic actuator 13 is preferably double-acting, hydraulic fluid can be provided to either side of the piston 17 such that the piston rod 18 can be extended or retracted with respect to the cylinder 15 by the hydraulic fluid pressure. Fluid is supplied to the side of the piston 17 which contains the piston rod 18 (otherwise referred to herein as "the upper section of the cylinder 15") by a first supply line 29 which is connected to a source of hydraulic fluid. A second supply line 31 connected to the source of hydraulic fluid provides fluid to the other side of piston 17 (otherwise referred to herein as "the lower section of the cylinder 15").

The differential pressure switch 28 in the embodiment shown in FIG. 2 includes a first chamber 33 having a fluid port 35 at one end connected to the first supply line 29, and a second chamber 37 having a fluid port 39 at one end connected to the second supply line 31. The first and second chambers 33, 37 each include a sealing member which is preferably in the form of a moveable piston 41, 42. A region between the first chambers piston 41 and fluid port 35 defines a first fluid cavity 43 in which hydraulic fluid is located. A region between the second chambers piston 42 and fluid port 39 defines a second fluid cavity 45 in which hydraulic fluid is located.

The differential pressure switch 28 in the embodiment shown in FIG. 2 further includes a rigid drive rod or arm 47 having one end connected to the first chambers piston 41 and the other end connected to the second chambers piston 42. In this regard, opposing ends walls of the first and second chamber 33, 37 each have an aperture through which the drive arm 47 is located. The rigid drive arm 47 includes a protruding member 49 which is positionable to operate an electrical switch 51 to activate the overload indicator 27 (not shown in FIG. 2). A spring 53 is located in the first chamber 33 to bias the first chamber's piston 41 and the rigid drive arm 47 to a position which prevents the protruding member 49 from closing the electrical switch 51. An adjustable spacer 57 is provided between the spring 53 and end wall of the first chamber 33 to enable the amount of biasing force provided by the spring 53 to be adjusted.

If a force is applied to extend the piston rod 18 away from the cylinder 15, for example due to the position and weight of a patient on the table top 1, the hydraulic fluid pressure in the upper section of the cylinder 15 increases which in turn causes fluid pressure in the first fluid cavity 43 to increase. The force produced by the increase in fluid pressure then acts on the first chamber's piston 41 and drive arm 47 attached thereto. At the same time, the pressure in the lower section of the cylinder 15 decreases which in turn causes fluid pressure in the second fluid cavity 45 to decrease. The decrease in pressure results in less force being imparted on the second chamber's piston 42.

Similarly, if a force is applied to retract the piston rod 18 towards the cylinder 15, the hydraulic fluid pressure in the upper section of the cylinder 15 decreases, resulting in a decrease in the fluid pressure in the first fluid cavity 43 and thereby less force being imparted on the first chamber's piston 41. At the same time, the pressure in the lower section of the cylinder 15 increases which results in more force being imparted on the second chamber's piston 42 which then acts on the drive arm 47 attached thereto.

In order for the differential pressure switch 28 to be activated the protruding member 49 of the drive arm 47 must be sufficiently displaced to close the electrical switch 51. In this regard, the force imparted to the drive arm 47 by the first chamber's piston 41 minus the force imparted to the drive arm 47 by the second chamber's piston must be sufficient to overcome the bias force provided by the spring 53 on the first chamber's piston 41, and drive arm 47 attached thereto, such that the drive arm 47 and protruding member 49 of the drive arm 47 are moved to close the electrical switch 51. The spring 53 is preferably adjusted to provide a bias force of approximately 2000 psi. Accordingly, in order for the differential pressure switch 28 to be activated the hydraulic fluid pressure in the upper section of the cylinder 15 minus the hydraulic fluid pressure in the lower section of the cylinder 15 must be at least more than approximately 2000 psi. In other words, the differential hydraulic fluid pressure of the actuator 13 must be at least more than approximately 2000 psi. Under normal operating conditions of the surgical table, for example with the patient and table top 1 stationary and generally located directly over the support column 5, the hydraulic fluid pressure in the upper section of the cylinder 15 is approximately 1500 psi. However, if the patient is particularly heavy and/or is positioned at one end of the table top 1 and/or the table top 1 is moved to certain positions with respect to the base assembly 3, the fluid pressure in the upper section of the cylinder 15 minus the fluid pressure in the lower section of the cylinder 15 may increase to a point where the pressure difference, i.e. the differential hydraulic fluid pressure across the piston 17, exceeds approximately 2000 psi thereby activating the overload indicator 27.

The overload detection means preferably operates at all times irrespective of whether a main operating controller of the surgical table is on or off. In this respect, the overload detection means draws no electric current from the battery 26 until such time as the hydraulic pressure switch is activated and an audible and/or visual warning signal is emitted. Although, the overload detection means is only connected to the Trendelenburg actuator 13 in FIG. 1, it is however possible for further actuators and associated overload detection means to be used to monitor movement of the table top 1 in other directions, for example lateral tilt about the longitudinal axis of the table top 1.

In another embodiment of the invention, the differential pressure switch is in the form of a pressure transducer, preferably a differential pressure transducer, which senses and measures the hydraulic fluid pressure within the actuator 13, preferably in the upper section of the cylinder 15 and in the lower section of the cylinder 15. In this particular embodiment, the differential pressure transducer continuously measures the pressure within the actuator 13 and provides an electrical output signal to a microprocessor of a signal processing unit where it is thereby determined as to whether the measured differential pressure passes a predetermined value. The differential pressure switch in the embodiment shown in FIG. 3 includes a first pressure transducer 58 connected to the first supply line 29 and a second pressure transducer 59 connected to the second supply line 31. The first and second pressure transducers 58, 59 measure pressure within the upper section and lower section of the cylinder 15, respectively, with electrical outputs from the pressure transducers 58, 59 being connected to a signal processor 60. The signal processor 60 contains a microprocessor which calculates the resultant voltage by subtracting the output voltage of the second pressure transducer 59 from the output voltage of the first pressure transducer 58. The resultant voltage is compared with predetermined upper and lower limit values. If the resultant voltage is outside of the limit values, an output signal 61 from the signal processor 60 is provided to initiate activation of the overload indicator 27.

Most modern hydraulically actuated surgical tables have a microprocessor connected to a hand operated controller for controlling movement of the table top 1. Accordingly, rather than having a dedicated signal processing unit 60, the pressure transducers 58, 59 can be connected to the microprocessor of the surgical table. The predetermined value for the differential pressure within the hydraulic actuator 13 can thereby be programmed into the surgical table via the hand operated controller, in the same manner as various other operating parameters of the table would normally be set. An advantage of connecting the pressure transducers 58, 59 to the existing microprocessor of the surgical table is that the pressure values at which an overload signal is to be emitted can be set to different values for different positions of the table top 1 with respect to the support column 5.

In another embodiment of the invention, the sensor of the overload detection means can be in the form of a force transducer with the parameter of the surgical table sensed by the force transducer being force applied on the actuator or a mounting point of the actuator. A sensor of this type is particularly suited for older surgical tables which do not use hydraulic actuators to move the table top 1. Instead, these older surgical tables have an electromechanical actuator whereby an electric motor drives a leadscrew to move the table top 1. A force transducer, for example a strain gauge can be fitted to one end of the actuator to measure the force being imparted on the actuator by the weight and/or position of the patient on the table top 1.

The surgical table advantageously provides an audible and/or visual alert signal when the overload detection means determines that a predetermined load limit has been reached. Accordingly, medical staff are thereby provided with advanced warning that a patient is too heavy to be safely supported in any position on the table top 1 or is of a weight that can not safely be support in a particular position on the table top 1.

As the present invention may be embodied in several forms without departing from essential characteristics of the invention, it should be understood that the above described embodiments should not be considered to limit the present invention but rather should be construed broadly. Various modifications and equivalents are intended to be included within the spirit and scope of the invention. For example, the actuator may be hydraulic, pneumatic, electric or mechanical.

What is claimed is:

1. A surgical table for supporting a patient, the surgical table comprising:

a base assembly;

a table top for supporting a patient thereon, the table top being moveable with respect to the base assembly;

at least one hydraulic actuator having a piston for controlling the position of the table top with respect to the base assembly; and an overload detection means for detecting when the surgical table is overloaded, the overload detection means including a hydraulic pressure switch for sensing a differential pressure across the piston;

wherein the overload detection means emits a signal if the differential pressure sensed across the piston exceeds a predetermined value, due to the weight and position of the patient on the table top.

2. A surgical table as claimed in claim 1 wherein the piston is within a cylinder of the hydraulic actuator, the piston dividing the cylinder into an upper section and a lower section, and wherein the pressure switch includes:

a first chamber having a fluid port connected to an upper section of the cylinder by a first hydraulic fluid line; and a second chamber having a fluid port connected to the lower section of the cylinder by a second hydraulic fluid line.

3. A surgical table as claimed in claim 2 wherein the first and second chambers each include a sealing member, wherein a region between the first chamber's sealing member and the first chamber's fluid port define a first fluid cavity, and a region between the second chamber's sealing member and the second chamber's fluid port define a second fluid cavity.

4. A surgical table as claimed in claim 3 wherein an increase or decrease in hydraulic fluid pressure in the upper section of the cylinder provides a corresponding increase or decrease in hydraulic fluid pressure in the first fluid cavity.

5. A surgical table as claimed in claim 3 wherein an increase or decrease in hydraulic fluid pressure in the lower section of the cylinder provides a corresponding increase or decrease in hydraulic fluid pressure in the second fluid cavity.

6. A surgical table as claimed in claim 4 wherein the corresponding increase or decrease in the hydraulic fluid pressure in the first and second fluid cavities acts on the sealing members.

7. A surgical table as claimed in claim 3 wherein the pressure switch further includes a drive arm having one end connected to the first chamber's sealing member and the other end connected to the second chamber's sealing member.

8. A surgical table as claimed in claim 7 wherein the drive arm includes a member which is positionable to operate an electrical switch, to activate an overload indicator of the overload detection means, when the differential pressure sensed exceeds the predetermined value.

9. A surgical table as claimed in claim 8 wherein the signal emitted if the differential pressure sensed exceeds the predetermined value is an audible or visual signal from the overload indicator.

10. A surgical table as claimed in claim 8 wherein the first chamber further includes a spring positioned therein to bias the first chamber's sealing member and the drive arm to a position which prevents the drive arm from closing the electrical switch.

11. A surgical table as claimed in claim 10 wherein the first chamber further includes an adjustable spacer between the spring and an end wall of the first chamber for enabling adjustment of the biasing force of the spring.

12. A surgical table as claimed in claim 11 wherein the drive arm is able to close the electrical switch when the hydraulic fluid pressure in the first fluid cavity minus the hydraulic fluid pressure in the second fluid cavity is greater than the biasing force of the spring.

13. A surgical table as claimed in claim 12 wherein the biasing force of the spring is approximately 2000 psi.

14. A surgical table as claimed in claim 1 wherein the pressure switch includes a first pressure transducer and second pressure transducer for sensing and measuring the differential hydraulic fluid pressure across the piston of the hydraulic actuator.

* * * * *